US007632380B2

(12) United States Patent
Doublet

(10) Patent No.: US 7,632,380 B2
(45) Date of Patent: Dec. 15, 2009

(54) ARTICLE FORMED FROM AT LEAST A FIBROUS MATERIAL JET COMPRISING AT LEAST A NULL THICKNESS ZONE AND METHOD FOR MAKING SAME

(75) Inventor: Pierre Doublet, Saint-Brice (FR)

(73) Assignee: Arjowiggins Security, Paris (FR)

( * ) Notice: Subject to any disclaimer, the term of this patent is extended or adjusted under 35 U.S.C. 154(b) by 578 days.

(21) Appl. No.: 10/515,059

(22) PCT Filed: May 21, 2003

(86) PCT No.: PCT/FR03/01528

§ 371 (c)(1),
(2), (4) Date: Nov. 19, 2004

(87) PCT Pub. No.: WO03/097937

PCT Pub. Date: Nov. 27, 2003

(65) Prior Publication Data

US 2005/0173084 A1 Aug. 11, 2005

(30) Foreign Application Priority Data

May 22, 2002 (FR) ..... 02 06190

(51) Int. Cl.
*D21H 27/02* (2006.01)
*D21H 27/32* (2006.01)
*B32B 27/04* (2006.01)

(52) U.S. Cl. ..... 162/140; 162/123; 162/134; 162/162; 162/104; 428/156; 428/172; 283/72

(58) Field of Classification Search ..... 162/134–135, 162/140, 158, 123–133, 162, 181.1, 103–104, 162/10, 108; 428/131, 137–139, 537.5, 156, 428/172; 283/72, 83, 94, 112, 113, 107–108; 427/361, 391; 83/72, 83, 94, 112, 113
See application file for complete search history.

(56) References Cited

U.S. PATENT DOCUMENTS

| | | | | | |
|---|---|---|---|---|---|
| 987,678 | A | * | 3/1911 | Howes | 162/126 |
| 1,281,951 | A | * | 10/1918 | Harper | 162/134 |
| 1,901,049 | A | * | 3/1933 | Von Heinrich | 162/110 |
| 2,019,845 | A | * | 11/1935 | Colbert et al. | 162/124 |
| 2,862,251 | A | * | 12/1958 | Kalwaites | 264/119 |
| 3,150,416 | A | * | 9/1964 | Such | 264/119 |
| 4,096,216 | A | * | 6/1978 | Yevick | 264/1.6 |
| 4,246,307 | A | * | 1/1981 | Trautwein | 428/43 |

(Continued)

FOREIGN PATENT DOCUMENTS

DE 10163381 A1 * 7/2003

(Continued)

*Primary Examiner*—José A Fortuna
(74) *Attorney, Agent, or Firm*—Westerman, Hattori, Daniels & Adrian, LLP

(57) ABSTRACT

The present invention relates to an article formed from at least one ply of fibrous material comprising at least one region of zero thickness, characterized in that said region is covered on at least one of its faces with an at least partly transparent or translucent structure placed so as to reveal a transparent or translucent window in the paper.

11 Claims, 5 Drawing Sheets

U.S. PATENT DOCUMENTS

| | | | | |
|---|---|---|---|---|
| 4,324,421 | A * | 4/1982 | Moraw et al. | 283/75 |
| 4,437,935 | A * | 3/1984 | Crane, Jr. | 162/103 |
| 4,462,866 | A | 7/1984 | Tooth et al. | |
| 4,943,093 | A * | 7/1990 | Melling et al. | 283/83 |
| 5,388,862 | A * | 2/1995 | Edwards | 283/82 |
| 5,791,553 | A * | 8/1998 | Fabel | 229/92.1 |
| 5,868,902 | A * | 2/1999 | Howland et al. | 162/140 |
| 6,155,476 | A * | 12/2000 | Fabel | 229/92.3 |
| 6,209,779 | B1 * | 4/2001 | Fabel | 229/92.3 |
| 6,355,140 | B1 * | 3/2002 | Murakami et al. | 162/140 |
| 6,402,888 | B1 * | 6/2002 | Doublet et al. | 162/140 |
| 2002/0058111 | A1 * | 5/2002 | Debikey et al. | 427/385.5 |
| 2003/0044573 | A1 * | 3/2003 | Rasch et al. | 428/131 |
| 2005/0173084 | A1 * | 8/2005 | Doublet | 162/109 |
| 2005/0224203 | A1 * | 10/2005 | Boehm et al. | 162/140 |
| 2006/0198987 | A1 * | 9/2006 | Grob et al. | 428/137 |
| 2007/0029784 | A1 * | 2/2007 | Moreau | 283/72 |
| 2007/0085337 | A1 * | 4/2007 | Endres et al. | 283/81 |
| 2008/0107875 | A1 * | 5/2008 | Rosset et al. | 428/197 |
| 2008/0273701 | A1 * | 11/2008 | Perori et al. | 380/277 |
| 2009/0033914 | A1 * | 2/2009 | Doublet | 356/71 |
| 2009/0087651 | A1 * | 4/2009 | Doublet et al. | 428/337 |
| 2009/0186205 | A1 * | 7/2009 | Doublet et al. | 428/215 |

FOREIGN PATENT DOCUMENTS

| | | | |
|---|---|---|---|
| EP | 0 773 320 | | 5/1997 |
| FR | 2 764 314 | | 12/1998 |
| GB | 1 604 463 | | 12/1981 |
| GB | 2306178 | A * | 4/1997 |
| WO | WO 9420679 | A1 * | 9/1994 |
| WO | WO 9420683 | A1 * | 9/1994 |
| WO | WO 95/09274 | | 4/1995 |
| WO | WO 03/055683 | A1 * | 7/2003 |
| WO | WO 03/097937 | A2 * | 11/2003 |
| WO | WO 2006090026 | A1 * | 8/2006 |
| WO | WO 2007031694 | A1 * | 3/2007 |
| WO | WO 2007071866 | A2 * | 6/2007 |
| WO | WO 2007141459 | A2 * | 12/2007 |
| WO | WO 2008006983 | A1 * | 1/2008 |

* cited by examiner

ARTICLE FORMED FROM AT LEAST A FIBROUS MATERIAL JET COMPRISING AT LEAST A NULL THICKNESS ZONE AND METHOD FOR MAKING SAME

The present invention relates to an article comprising a fibrous layer and an at least partially transparent or translucent structure, and also to the method of manufacturing said article.

The invention relates more particularly to the manufacture in general of security papers that include a transparent window.

In this regard, mention may be made of a number of examples drawn from the prior art possessing a similar structure but obtained using quite different manufacturing methods.

In patent EP 690 939, the Applicant disclosed a security paper having a transparent window obtained by inserting a plastic film between two plies of fibrous material.

This technique consists in embossing two strips of paper in the course of formation, by means of raised parts integrated into the wire screen of a cylinder mold paper machine, these raised parts being high enough to prevent the deposition of paper fibers at certain points on the paper strip. This results in a through-hole in the paper.

Next, two fibrous layers are jointed together so as to bring the hole in one fibrous layer so as to face that in the other layer, the plastic film passing through the place of the superposed holes. This results in a transparent window in the paper.

However, this technique has a number of drawbacks.

One of the drawbacks is that the film sandwiched in the structure of the paper may cause deformations of the sheet. Since the sheet is no longer flat, the paper on the one hand loses some of its attraction and, on the other hand, is not easily printable and/or stackable.

In addition, this method of forming the windows in the paper also has the following drawbacks:

On the embossed edges of the paper, certain defects may thus appear. Firstly, the edges are not regular and straight. Secondly, this method of embossing the paper results in an effect that is often frequent and difficult to avoid, namely the appearance of "barbs", that is to say fibers or fibrils that extend beyond the edges, resulting from the paper not being cut properly but pushed back toward the outside. A fiber that has succeeded in withstanding the tensile force of the embossing mold consequently remains partly caught in the fibrous structure, the remaining part extending beyond the hole thus formed.

One of the objects of the invention is therefore to eliminate the drawbacks of the prior art as mentioned above.

Another object of the invention is therefore to form a transparent window in a paper based on a cellulose material by cutting or embossing its surface.

For this purpose, the Applicant proposes to no longer apply a transparent plastic film on the inside of two fibrous layers, but to deposit an at least partly transparent or translucent structure, especially a transparent plastic film, a tracing paper or a printed patch having a transparent window, directly on the fibrous layer at the position of the hole formed in the fibrous layer by embossing, so as to conceal the ill-formed edges of the hole by means of opaque parts present beforehand or deposited subsequently on the applied structure and surrounding an at least partly transparent or translucent region thereof.

Another solution envisioned by the Applicant is to form the hole in the fibrous layer by means of a cutting device downstream of the formation of the fibrous layer, so as to avoid the appearance of the "barb" effect and then to cover this hole with an at least partly transparent or translucent structure, it being possible for this structure to be, for example, a transparent plastic film, a tracing paper or a printed patch that includes a plastic window.

Consequently, the invention firstly relates to an article formed from at least one ply of fibrous material comprising at least one region of zero thickness, characterized in that said region is covered on at least one of its faces with an at least partly transparent or translucent structure placed so as to reveal a transparent or translucent window in the paper.

In this article, the aforementioned structure may be covered with an opacifying substance so as to conceal the edges of the hole formed in the fibrous material.

This opacifying substance may be chosen from printing inks, liquid crystals, metal particles, magnetic particles, thermochromic substances and iridescent substances.

Specifically, the at least partly transparent or translucent structure may be a tracing paper, a transparent plastic film or a printed patch that includes a plastic window.

In the case of a patch, the dimensions of the latter must be larger than the hole formed in the fibrous material so that the edges of the hole formed in the fibrous material are concealed by the patch, the edges of the transparent window in the patch being placed above the empty space left by the hole formed in the fibrous material.

In particular, especially in the case of application to value or security papers, it is possible to apply, to the at least partly transparent or translucent structure, in particular a plastic film, a tracing paper or a patch, a security substance chosen from metal particles, magnetic particles, thermochromic substances, iridescent substances, liquid crystals and mixtures thereof.

Another way of providing said article with security is also to apply a diffractive element to said at least partly transparent or translucent structure so as to create a security hologram, which would prevent any fraudulent copies of the article, for example by reprographic techniques.

Other devices for protection against falsification are conceivable for said article.

Thus, it is possible to provide a step of printing the article in question, once the at least partly transparent or translucent structure has been deposited on the holed region of the fibrous layer so as to consolidate the assembly from the document security standpoint.

The hole in the transparent window may also be used to place thick elements, having a thickness of around 100 μm up to the thickness of the article.

These thick elements will be placed on the at least partly transparent or translucent structure, whether on the front side or the reverse side.

Such elements may for example be printed circuits, microprocessors, electronic chips, magnetic elements, metallic elements, plastic elements, detection devices that emit a signal when they are placed in a suitable light or electromagnetic field.

In the case of electronic circuits, an antenna may be deposited at the same time and coupled to the circuit on the at least partly translucent or transparent element.

These elements may also be thick so as to allow the document to be recognized by the blind, owing to the difference in thickness created.

Thus, a number of discrete thick particles, such as crystals, metal or plastic particles, or an object having differences in thickness, are conceivable at this point.

Although the article obtained by the present invention may be perfectly suitable for all types of application, it is particularly intended for the formation of bank notes, security papers in general, gift vouchers, value documents in general, coupons, labels for protecting a brand or product, traceability labels.

Likewise, the invention relates to the method of manufacturing said article described below.

The method comprises the following steps:

formation of at least one ply of fibrous material;

production of a hole in the fibrous material;

deposition of an at least partly transparent or translucent structure at the position of the hole on the front side and/or on the rear side of the fibrous layer, so as to reveal a transparent or translucent window in the article.

The structure may include at least one of the following elements: a holographic and/or diffractive element; a magnetic, metallic or crystalline coating; liquid crystals; printing with a varnish or an ink; iridescent pigments; thermochromic and/or piezochromic pigments; at least one reflective surface.

It may also include a plastic film, especially a polyester film.

The structure will be composed of a single layer or of at least two layers, one of which is a carrier layer intended to be removed during transfer of the structure onto the sheet.

In the latter case, the carrier layer may comprise a plurality of portions of film or of fibrous material, these portions being placed in such a way that, after they have been transferred onto the sheet, they are spaced apart on the surface of the sheet.

Advantageously, a structure will initially comprise at least the following layers:

a carrier layer;

a release layer;

optionally, a layer of lacquer containing a resin and optionally a pigment or dye;

a layer of metal, plastic or fibrous material; and an adhesive layer.

The deposition of the at least partly transparent or translucent structure may take place either by hot or cold transfer at the position of the hole on the front side and/or reverse side of the fibrous layer, or by hot or cold lamination on the front side and/or reverse side of the fibrous layer.

The hole may be formed either by means of an embossing roller, during the wet phase of the fibrous layer, or by means of a mechanical cutting or laser cutting device.

Optionally, the article may then be printed or covered with a security substance chosen from metal particles, magnetic particles, thermochromic substances, iridescent substances, liquid crystals.

Additionally, at least one thick element is placed on the front side and/or reverse side of the at least partly transparent or translucent structure, the thick element being chosen from printed circuits, microprocessors, electronic chips, magnetic elements, metal elements, plastic elements, detection devices that emit a signal in the presence of a suitable light or electromagnetic field.

The invention will be more clearly understood on reading the following detailed description of nonlimiting illustrative examples and on examining the appended drawings, in which:

FIGS. 1A and 1B show a medium (1) formed from a single fibrous ply, having a through-hole (2) in its surface, formed by means of an embossing roller during the wet forming of the sheet.

The fibrous layer (1) is produced from cellulose fibers that may optionally contain synthetic or artificial fibers.

It may be seen that the edges of the hole are irregular and not straight.

Extending beyond the edges of the hole are "barbs", fragments of fibers that are still partly attached to the rest of the fibrous layer and isolated from the latter during embossing of the hole.

Figure 1A:
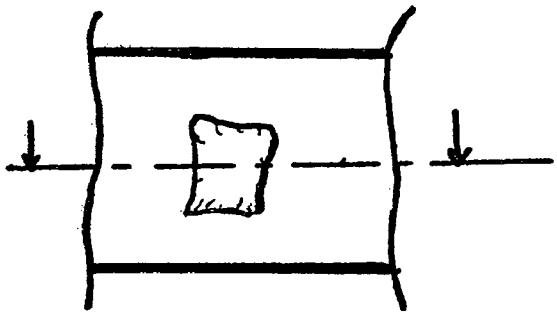
FIGS. 1A and 1B show schematically and in part, in a top view and in cross section respectively, an article whose hole has been formed on a cylinder mold by embossing.
Figure 1B:
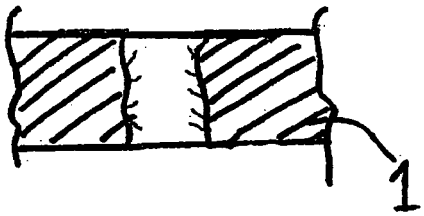
Figure 2A:
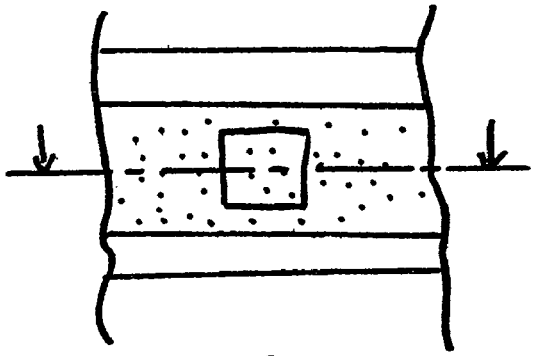
FIGS. 2A and 2B show schematically and in part, in a top view and in cross section respectively, an article whose hole has been formed by laser cutting and covered with a transparent film.
Figure 2B:
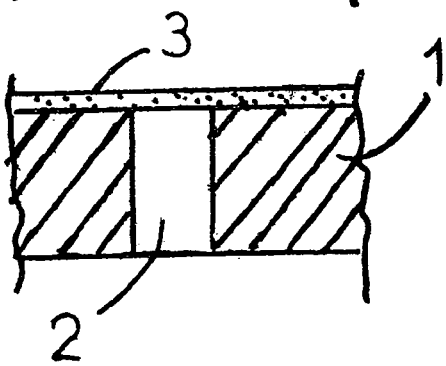

FIGS. 2A and 2B show a medium (1) formed from a single fibrous ply having a through-hole (2) in its surface, said hole being formed by means of a laser following formation of the fibrous layer.

It may be seen that the edges of the hole are straight and regular.

The rectangular shape of the hole is quite faithfully reproduced.

No "barb" can be seen with the naked eye.

Consequently, the transparent window may be easily obtained in this paper by covering the fibrous layer at the place of the hole with a transparent plastic film 3 on the front side, as shown in FIGS. 2A and 2B.

Figure 3A:
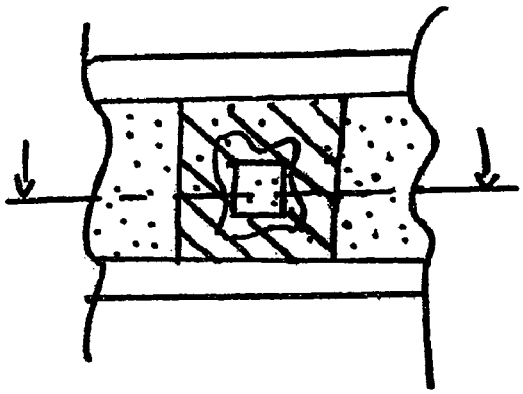
FIGS. 3A and 3B show, schematically and in part, in a top view and in cross section respectively, a covered article, the hole of which has been formed on a cylinder mold by embossing and covered with a transparent plastic film printed on its front side.
Figure 3B:
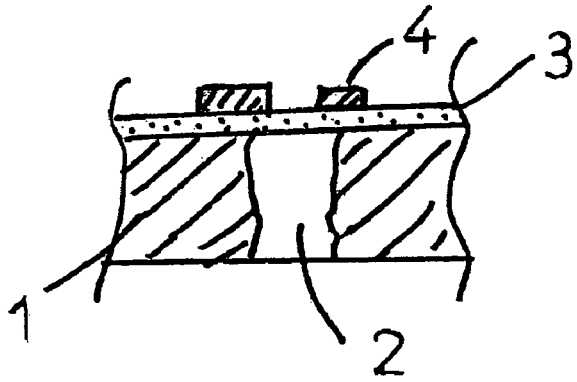

FIGS. 3A and 3B show one particular configuration of the invention, in which the single-ply fibrous layer (1) has been holed by embossing, with the appearance of "barbs".

The front side of the fibrous layer is covered with a transparent plastic film (3).

Said film is then covered with an opacifying substance (4) which, here, is composed of ink over a region surrounding the hole so as, on the one hand, to conceal the barbs and, on the other hand, to leave a transparent region on the inside of the covered hole.

Figure 4A:
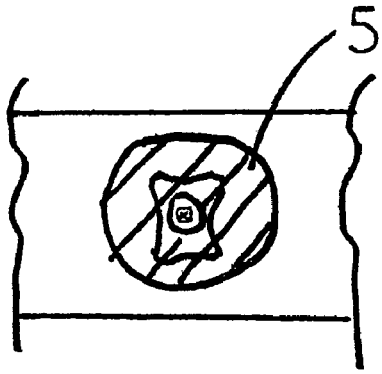
FIGS. 4A and 4B show, schematically and in part, in a top view and in cross section respectively, an article whose hole has been formed on a cylinder mold by embossing, covered with a patch printed on its front side and with a transparent film provided with an electronic chip on its reverse side.
Figure 4B:
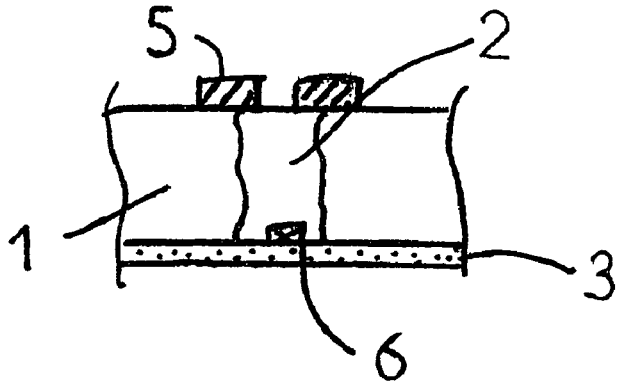

FIGS. 4A and 4B show a variant of the invention which a transparent film (3) is applied to the reverse side and an opaque patch (5) is applied to the front side so as to cover the hole, the patch having, however, a cut-out in the middle of it.

The region covered by the cut-out in the patch is placed so as again to conceal the "barbs" of the fibrous layer.

Since the transparent film itself bears an electronic chip (6) on its surface, it is necessary to place the chip in an adjusted manner inside the hole so as to avoid an overthickness in the article.

In the previous examples, the film (3) consists only of a single layer of transparent plastic, for example polyester.

It would not be outside the scope of the invention to use a different structure, especially a multilayer structure.

Figure 5:
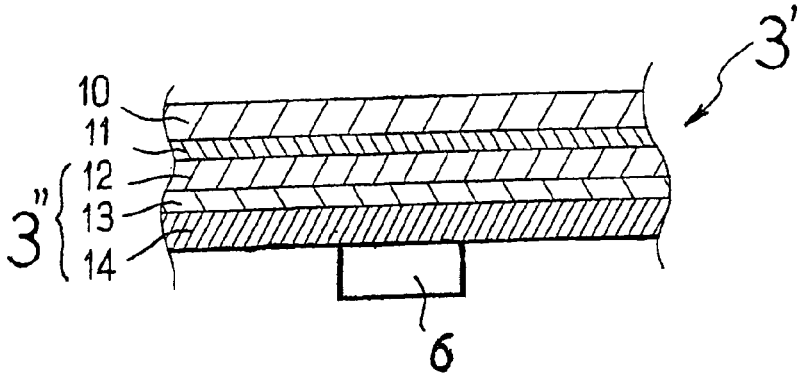
FIG. 5 is a schematic partial cross section of a structure that can be used.

To give an example, FIG. 5 shows a composite structure (3') comprising:

a polyester carrier layer (10);

a release layer (11), for example made of wax;

a lacquer layer (12) containing a resin and optionally a pigment or dye;

a metal layer (13), for example an aluminum layer;

an adhesive layer (14) for fastening an element (6) to the fibrous layer (1)—the adhesive layer (14) may be based on a hot-melt resin.

In the example described, the carrier layer (10) has a thickness of about 12 μm and the accumulative thickness of the layers (11) to (14) is about 2 to 3 μm.

The layers (12), (13) and (14) form a film (3") to be transferred onto the sheet (1).

The structure (3') is also called a "foil" and it allows the film (3") to be joined to the sheet (1), for example by hot pressing, during which operation the release layer (11) melts and allows the carrier layer (10) to be separated from the other layers. The heat provided during this operation also activates the adhesive layer (14) so as to thermally bond the film (3") to the sheet (1).

The metal layer (13), for example made of aluminum, may have a surface appearance that it makes it possible to reflect light through the colored lacquer layer (12), thus creating a color effect on the surface of the article.

The layer (12) may have a hologram consisting of a diffraction grating. The latter may be produced by means of a matrix of a transfer machine allowing the film (3") to be transferred onto the sheet (1). As a variant, the hologram may be produced before the layer (12) is assembled with the other layers.

The metal layer (13) may be replaced with a plastic layer.

The film (3) or (3") may or may not entirely cover one side of the article.

The film (3) or (3") may or may not extend continuously between two opposed edges of the article.

The film (3) or (3") may form a patch on the article.

A method for producing a fibrous layer comprising at least one through-hole will now be described with reference to FIG. 6.

Figure 6:
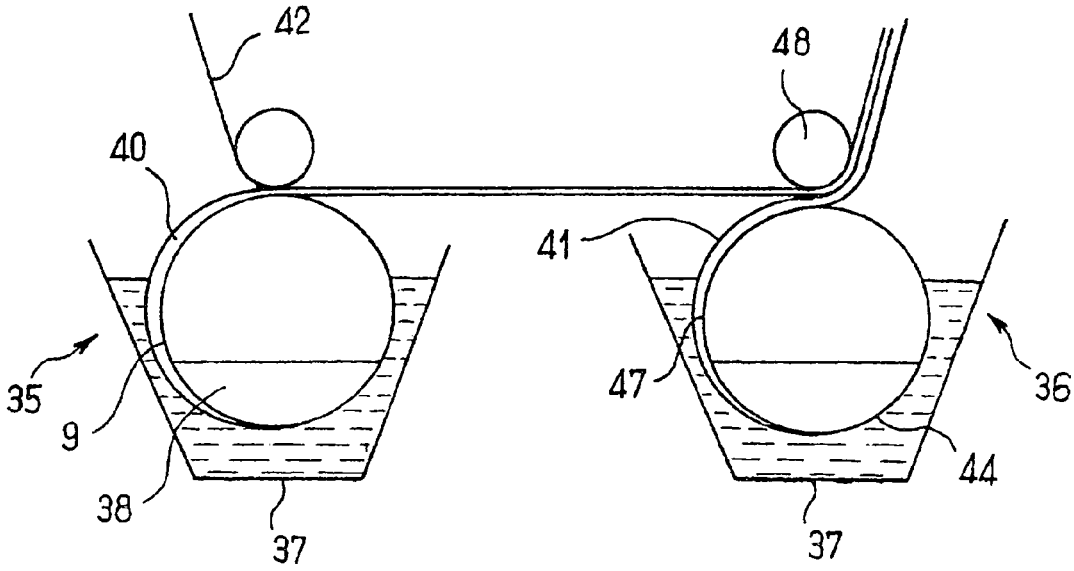
FIG. 6 shows schematically an installation for producing a fibrous layer having holes formed by embossing.

FIG. 6 shows, in part and schematically, two cylinder mold paper machines (35) and (36).

The first machine (35) includes a vat (37) containing a suspension of fibers, for example cellulose fibers, in which a rotating wire cylinder (38) is partly immersed, said cylinder defining a surface (39) in contact with which a paper ply (40) is continuously formed and pulled off by a pick-up felt (42). The surface (39) includes relief embossing so as to create through-holes in the first ply (40).

The second machine (36) includes, like the machine (35), a vat (37), a rotating wire cylinder (44) defining a surface (47) in contact with which a second paper ply is formed.

The surface (47) of the wire cylinder (44) includes relief embossing so as to create holes (46) in the second ply, the holes (46) being placed so as to be superposed with the holes (45) in the first ply during assembly of the two plies, the assembly taking place as the two plies pass between the cylinder mold (44) and a rotating roll (48).

Such an installation is in particular described in greater detail in European patent EP 0 687 324.

The sheet can be subsequently cut up to the format of the article to be produced.

Again the cavity may be produced by other means, for example using a laser or mechanical abrasion.

The film and the sheet may be joined together in many ways without departing from the scope of the invention.

Figure 7:
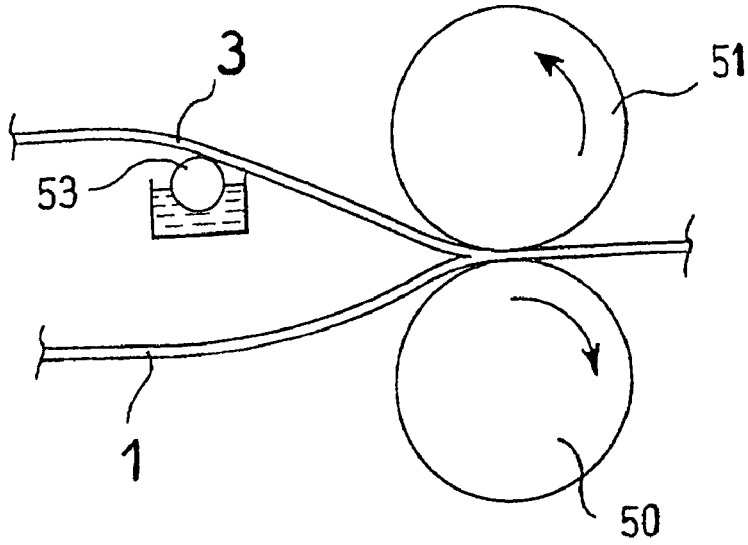
FIG. 7 illustrates schematically the lamination of a fibrous layer to a structure.

FIG. 7 shows schematically the lamination assembly of a film (3) to a fibrous layer (1) by passage between two rotating rolls (50) and (51). In this figure, the film (3) is brought beforehand into contact with a size press (53).

The film (3) and the sheet (1) may therefore be positioned, one with respect to the other by registration, in such a way that an opaque part on the film covers the edges of the cavity formed in the sheet (1). In the example in question, the film (3) remains permanently on the sheet (1).

Figure 8:
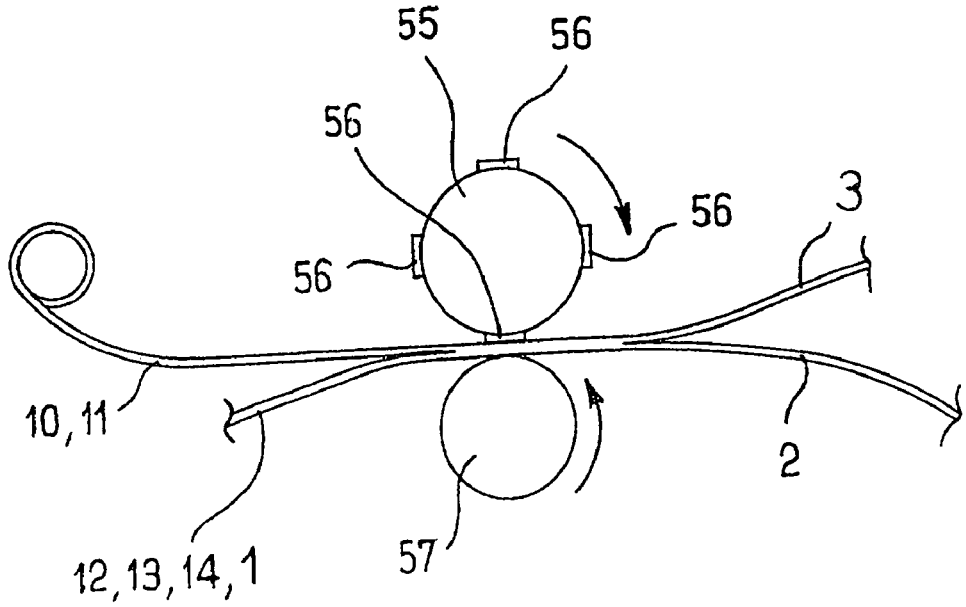
FIG. 8 shows schematically the transfer of a structure onto a fibrous layer.
Figure 9:
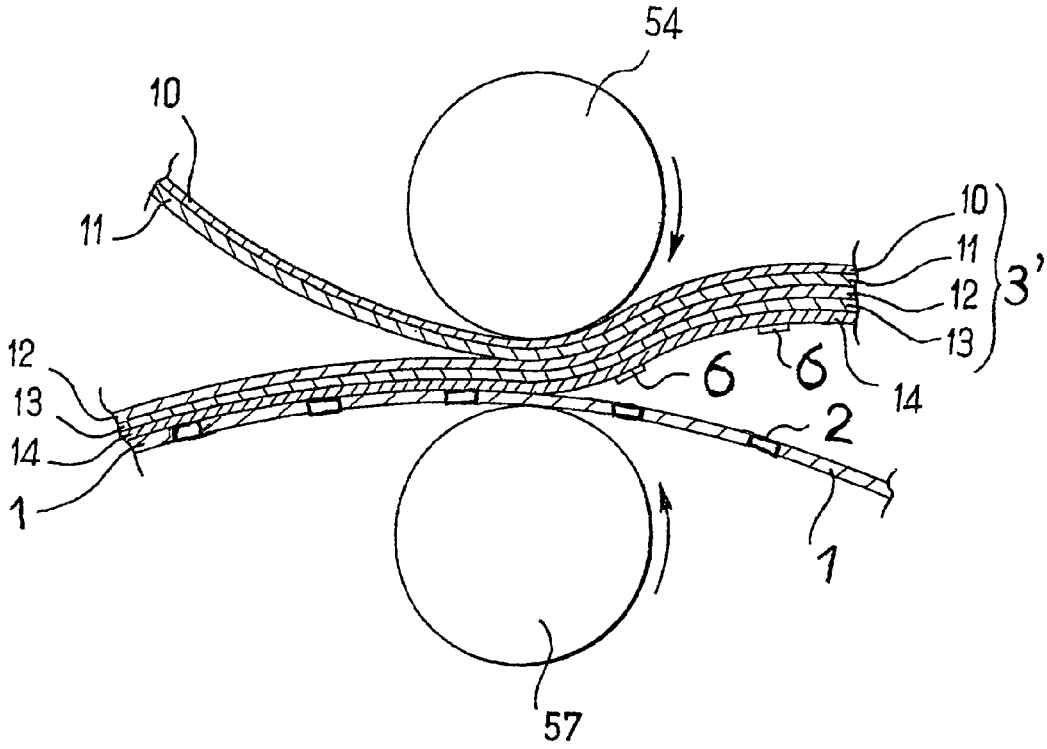
FIG. 9 shows, schematically and in part, a detail of FIG. 8.

In the case of the composite structure (3'), the film (12), (13),(14) may be transferred, for example by hot transfer, onto the sheet (1), as illustrated in FIGS. 7 and 8.

In such a transfer method, the sheet (1) and the structure (3') may be driven with the carrier layer (10),(11) so as to move in the same direction by means of a machine comprising a first rotating cylinder carrying dies (56) and a second rotating cylinder (57). The film (12),(13),(14) and the sheet (1) may be joined together as they pass between the cylinders (55) and (57). In FIG. 8, it may be seen that, after they pass between the rotating cylinders (54) and (57), the carrier layer and the release layer are separated from the other layers (12),(13) and (14) that are transferred onto the sheet (1).

The film (12),(13),(14) may also be brought between a die (56) and the sheet (1) in a direction generally transverse to the movement of the sheet, as described in European patent EP 0 473 635.

Of course, the invention is not limited to the illustrative examples that have just been described.

Each through-cavity may be closed on one side only by a film, or on both sides by two films.

Each through-cavity may also be closed on one side by a film and on the other side by a fibrous layer.

In particular when an element is placed in the cavity of the sheet by transfer, the layer of the structure bearing the element may be based on fibrous material.

The invention claimed is:

1. An article comprising fibrous material, wherein said fibrous material is in the form of (i) a single ply comprising fibers or (ii) a laminate comprising at least two plies, each of said two plies comprising fibers, wherein said fibrous material comprises at least one region of zero thickness forming a window in the fibrous material, wherein edges of said window are covered on at least one outside face of said fibrous material with an at least partly transparent or translucent structure placed so as to reveal the window in the fibrous material, wherein at least a portion of the structure is covered with an opacifying substance so as to conceal the edges of the window formed in the fibrous material, wherein at least a portion of the window is not covered by the opacifying substance.

2. The article as claimed in claim 1, wherein the opacifying substance is chosen from printing inks, liquid crystals, metal particles, magnetic particles, thermochromic substances and iridescent substances.

3. The article as claimed in claim 1, wherein the structure is a transparent plastic film.

4. The article as claimed in claim 1, wherein the structure is a tracing paper.

5. The article as claimed in claim 1, wherein the structure is a printed patch that includes a cut-out.

6. The article as claimed in claim 5, wherein the patch has larger dimensions than the hole formed in the fibrous material so that the edges of the hole formed in the fibrous material are concealed by the patch, the edges of the cut-out in the patch being placed above the empty space left by the hole formed in the fibrous material.

7. The article as claimed in claim 6, wherein the patch is covered with a security substance chosen from metal particles, magnetic particles, thermochromic substances, iridescent substances, liquid crystals and mixtures thereof.

8. The article as claimed in claim 1, wherein the at least partly transparent or translucent structure defines a security hologram.

9. The article as claimed in claim 1, wherein it defines an article chosen from a bank note, a security paper, a gift voucher, a value document, a coupon, a label for protecting a brand or product, and a traceability label.

10. The article as claimed in claim 1, wherein said fibrous material is in the form of a single ply comprising fibers.

11. The article as claimed in claim 1, wherein said fibrous material is in the form of a laminate comprising at least two plies, each of said two plies comprising fibers.

* * * * *

UNITED STATES PATENT AND TRADEMARK OFFICE

CERTIFICATE OF CORRECTION

PATENT NO. : 7,632,380 B2
APPLICATION NO. : 10/515059
DATED : December 15, 2009
INVENTOR(S) : Pierre Doublet It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 892 days.

Signed and Sealed this

Second Day of November, 2010

David J. Kappos

David J. Kappos
*Director of the United States Patent and Trademark Office*